US006043593A

United States Patent [19]

Pan

[11] Patent Number: 6,043,593

[45] Date of Patent: Mar. 28, 2000

[54] INSULATED STRUCTURE OF A LIGHT BULB ASSEMBLY

[76] Inventor: Wun Fang Pan, No. 123, Lane 99, Pu Din Road, Hsinchu, Taiwan

[21] Appl. No.: 09/076,452

[22] Filed: May 12, 1998

[51] Int. Cl.[7] ..... H01J 5/56

[52] U.S. Cl. ..... 313/318.01; 362/226; 362/806; 439/619; 439/699.2

[58] Field of Search ..... 313/318.01, 318.09, 313/318.1; 362/226, 306, 806; 439/619, 699.2

[56] References Cited

U.S. PATENT DOCUMENTS 5,700,082 12/1997 Peng ..... 362/226
5,722,860 3/1998 Pan ..... 439/619
5,810,621 9/1998 Tsai ..... 439/619
5,816,862 10/1998 Tseng ..... 439/699.2

*Primary Examiner*—Michael H. Day
*Attorney, Agent, or Firm*—Rosenberg, Klein & Lee

[57] ABSTRACT

An improved insulated structure of a light bulb assembly, includes a bulb engaged within a bulb holder received in a housing. An improved connecting beam with two lower steps is formed on the holder to be received in an inner hole having a similar configuration of the housing. After connecting the bulb holder and the housing, the light bulb assembly can provides a perfect sealed connection for insulating infiltrating water or moisture to prevent an electrical short circuit and damage.

1 Claim, 5 Drawing Sheets

INSULATED STRUCTURE OF A LIGHT BULB ASSEMBLY

BACKGROUND OF THE INVENTION

In prior art, a light bulb assembly of a light string, when it is used outdoors, must be waterproof to prevent from infiltrating water or moisture. The known structure of the light bulb assembly including a bulb holder with a bulb and a housing is not effective for obtaining a perfect sealed connection. The water or moisture would be infiltrated in the housing and contacts with two conductive wires at the same time that becomes a short circuit and damages the light bulb assembly. It is a main drawback to be overcome.

OBJECT OF THE INVENTION

The main object of the present invention is to provide an improved insulated structure of a light bulb assembly, which includes an improved bulb holder with a connecting beam and a related designed housing for receiving the holder to obtain a perfect insulation.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
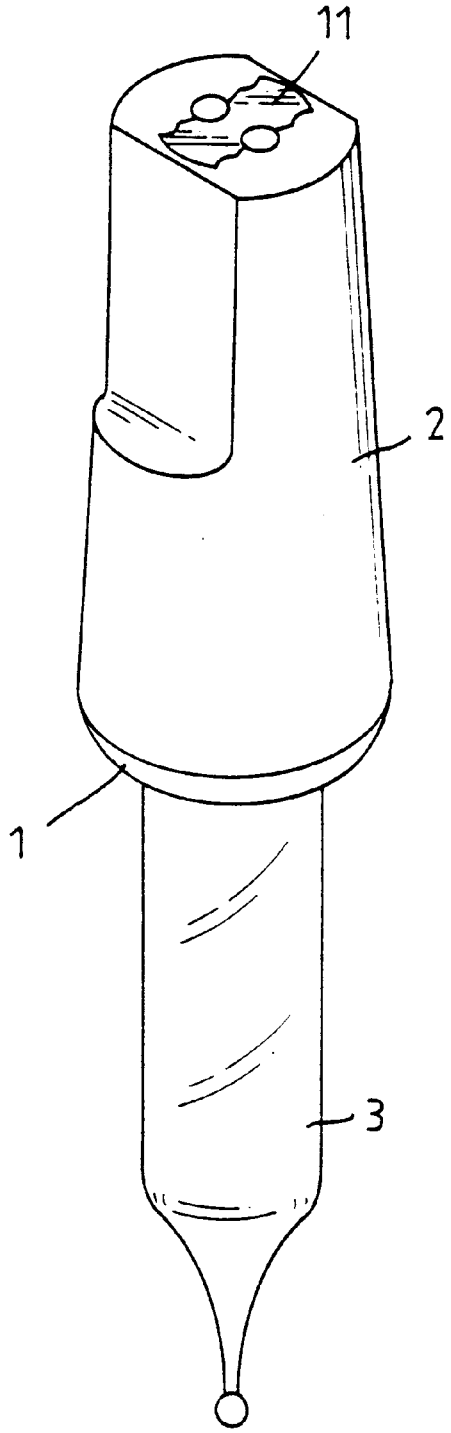
FIG. 1 is a perspective view of a light bulb assembly according to the present invention.
Figure 2:
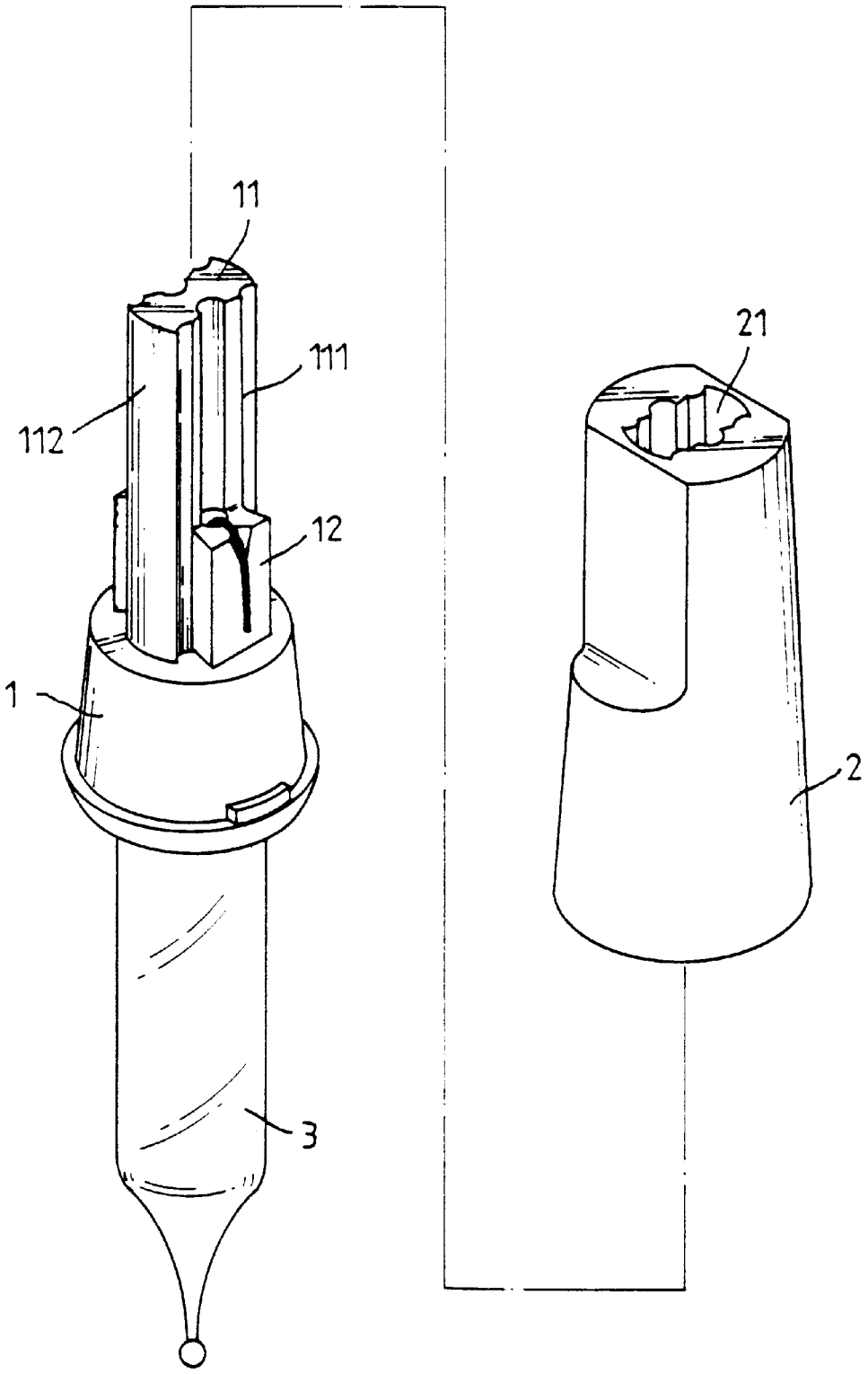
FIG. 2 is an exploded perspective view of a light bulb assembly according to the present invention.
Figure 3:
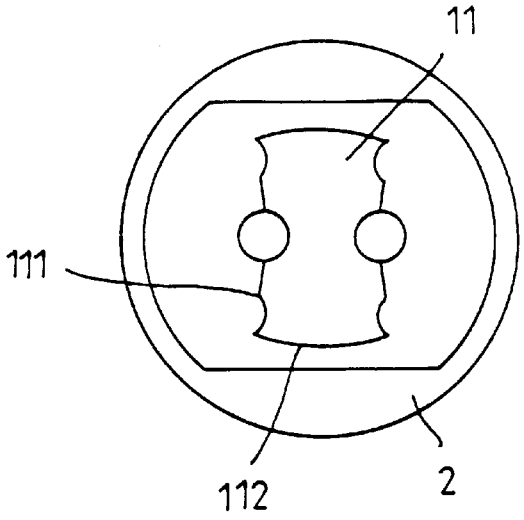
FIG. 3 is a top plan view of FIG. 1.

Please refer to FIGS. 1 to 2, a bulb (3) is engaged within a bulb holder (1) and received in a housing (2), as a prior art.

Figure 4:
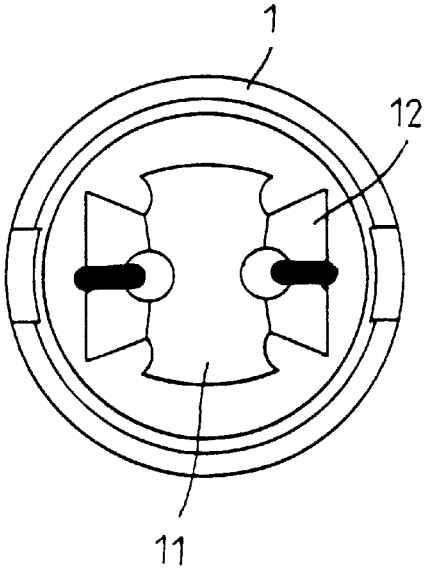
FIG. 4 is a top plan view of the bulb holder connected with the bulb according to the present invention.
Figure 5:
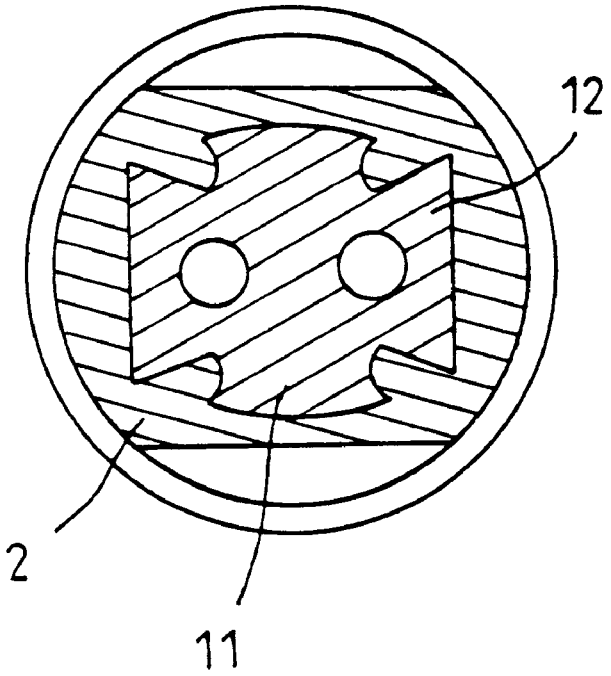
FIG. 5 is a cross sectional view of FIG. 1.
Figure 6:
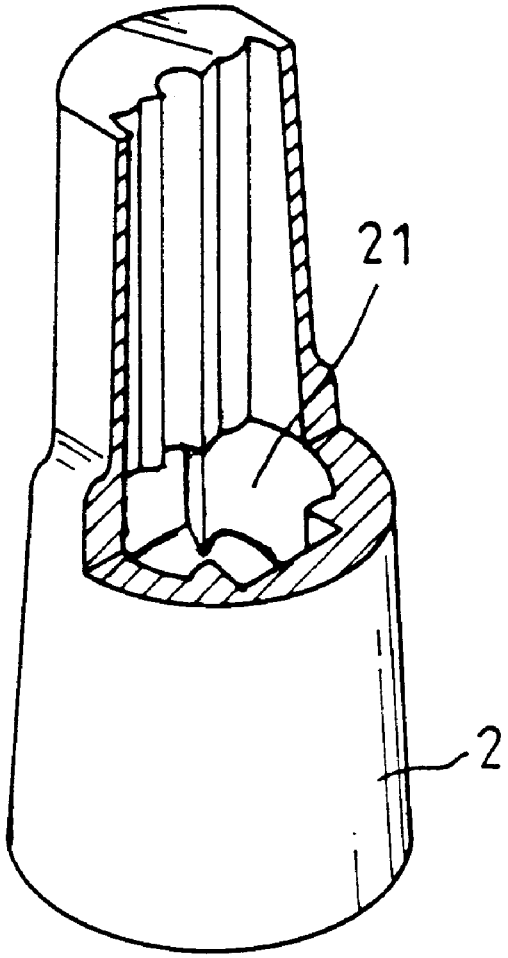
FIG. 6 is a partly cross perspective view of the housing according to the present invention.

The holder (1) is provided with a connecting beam (11) being received in the housing (2). It is a characteristic of the present invention that the designed configuration of the connecting beam (11). Referring to FIG. 4, there are two lower steps (12) provided on two sides of the beam (11). Two sides above the steps (12) of the beam (11) are continual zigzag surfaces (111) while the other two sides are arched surfaces (112). The lower step (12) has a configuration that the outer width is larger than the inner width. As shown in FIGS. 3–6, the housing (2) has an inner hole (21) being similar to the configuration of the bulb holder (1) with the beam (11) and the steps (12).

After the engagement of the holder (1) and the housing (2), there will be a perfect sealed connection between the holder (1) and the housing (2). In use, the rain or water will never be infiltrated into the housing (2) because of the connection between the continual zigzag surfaces (111) and the inner surfaces of the inner hole (21) of the housing (2). Even if the moisture is infiltrated, it will be insulated from the other side of the connecting beam (11). It will be understood that the connecting beam (11) and the steps (12) of the present invention can provide a complete insulation that the water or moisture will never be infiltrated to another side of the beam and that promises a secure use of the light bulb assembly.

I claim:

1. An improved insulated structure of a light bulb assembly including a bulb engaged within a bulb holder having a connecting beam received in a housing and being characterized in that:

the connecting beam having provided with two lower steps on two sides and the two sides above the steps being continual zigzag surfaces while the other two sides of the beam are arched surfaces;

the steps being a configuration that the outer width is larger than the inner width; the housing having an inner hole being similar to the configuration of the beam and the steps for receiving the housing in complete sealed engagement with a zigzag connecting interface for insulating infiltrating water or moisture.

* * * * *